US011793257B2

(12) United States Patent
Gupta

(10) Patent No.: US 11,793,257 B2
(45) Date of Patent: Oct. 24, 2023

(54) NEEDLE STORAGE DEVICE

(71) Applicant: DPG USA Inc., Schaumburg, IL (US)

(72) Inventor: Nikhil Gupta, Schaumburg, IL (US)

(73) Assignee: DPG USA INC., Schaumburg, IL (US)

( * ) Notice: Subject to any disclaimer, the term of this patent is extended or adjusted under 35 U.S.C. 154(b) by 751 days.

(21) Appl. No.: 16/936,920

(22) Filed: Jul. 23, 2020

(65) Prior Publication Data

US 2021/0022426 A1 Jan. 28, 2021

Related U.S. Application Data

(60) Provisional application No. 62/878,714, filed on Jul. 25, 2019.

(51) Int. Cl.
*A41H 19/00* (2006.01)

(52) U.S. Cl.
CPC ..... *A41H 19/00* (2013.01)

(58) Field of Classification Search
CPC ..... B65D 83/02; B65D 85/20; B65D 85/24; D05B 91/12; A61B 17/06; A61B 17/06114; A61B 17/06128; A61B 2017/06142; A41H 19/00
USPC ..... 206/380
See application file for complete search history.

(56) References Cited

U.S. PATENT DOCUMENTS

| | | | | | |
|---|---|---|---|---|---|
| 142,639 | A * | 9/1873 | Marchant et al. | ..... | A24F 15/06 312/73 |
| 3,951,263 | A * | 4/1976 | Vale | ..... | A41H 19/00 206/382 |
| 4,524,891 | A * | 6/1985 | Silva | ..... | A41H 19/00 206/382 |
| 4,802,581 | A * | 2/1989 | Takahashi | ..... | B65D 83/02 223/109 R |
| 5,941,430 | A * | 8/1999 | Kuwabara | ..... | A41H 19/00 206/382 |

* cited by examiner

*Primary Examiner* — Javier A Pagan
(74) *Attorney, Agent, or Firm* — Dunlap Bennett & Ludwig, PLLC; Anna L. Kinney

(57) ABSTRACT

A storage device for needles having: a tubular housing, a first cylindrical tube is retained in said tubular housing; first and second cylindrical tubes; the second tube is adapted to reciprocate within the first cylindrical tube; a third cylindrical tube is adapted fit over the first cylindrical tube; a mounting retainer is adapted to engage said tubular housing, the mounting retainer has a tubular protrusion extending therefrom, the tubular protrusion has a cylindrical bearing surface, the cylindrical bearing surface rotatably retains said third cylinder with a portion of said third cylinder protruding through said mounting retainer, a deformable needle mounting element is disposed with the second cylindrical tube, the deformable needle mounting element is adapted both to retain needles and allow withdrawal of needles therefrom, the second cylindrical tube is advanceable and retractable in the rotatable third cylindrical tube by turning of the third tube about its longitudinal axis.

12 Claims, 12 Drawing Sheets

Part1

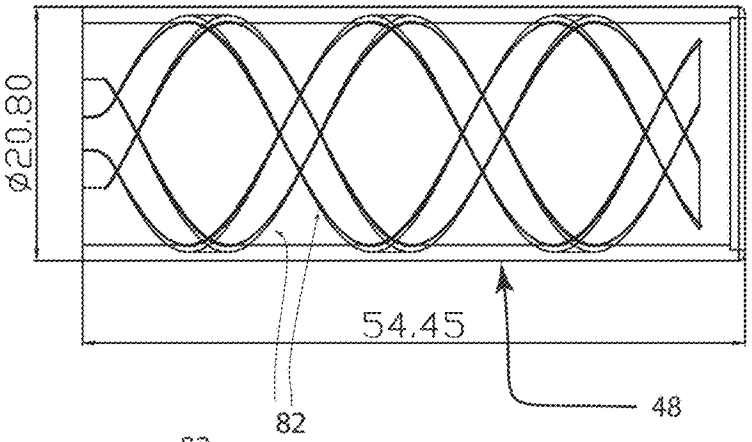
Figure 15
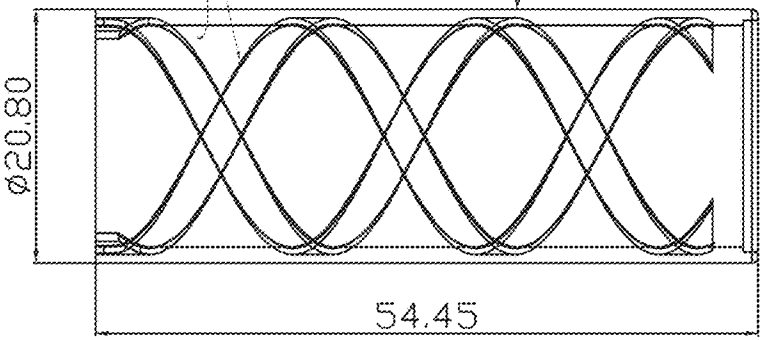
Figure 17
Part3 Figure 14
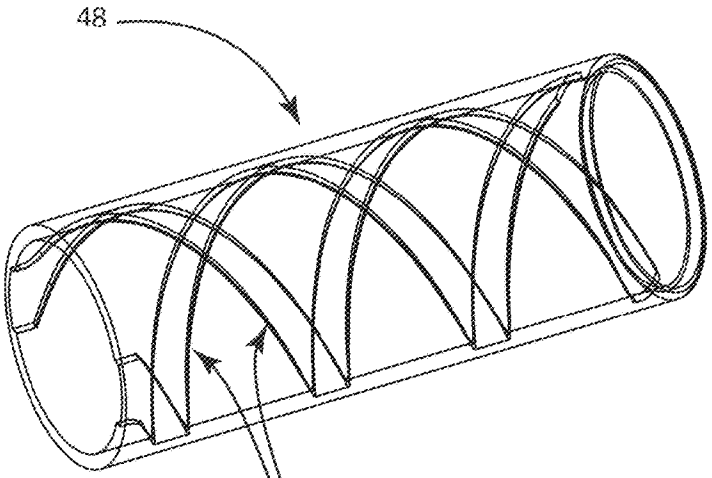
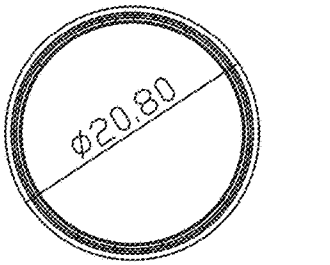
Figure 16

Part4

Part5

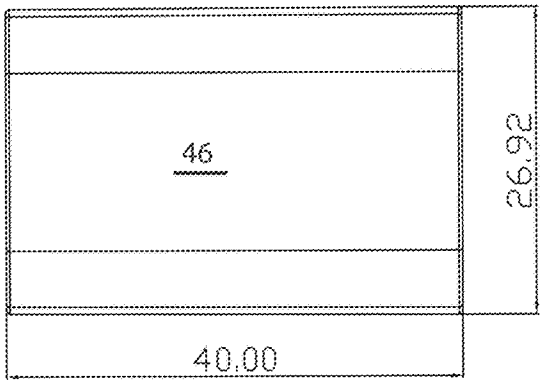
Figure 31
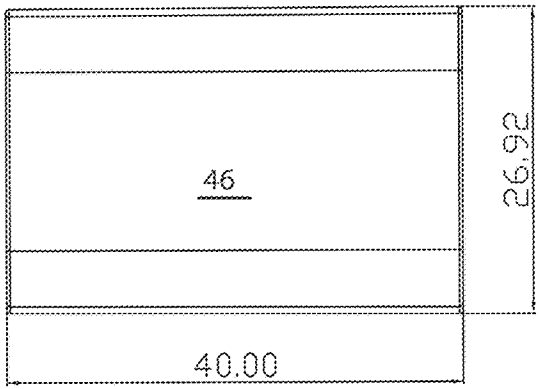
Figure 33
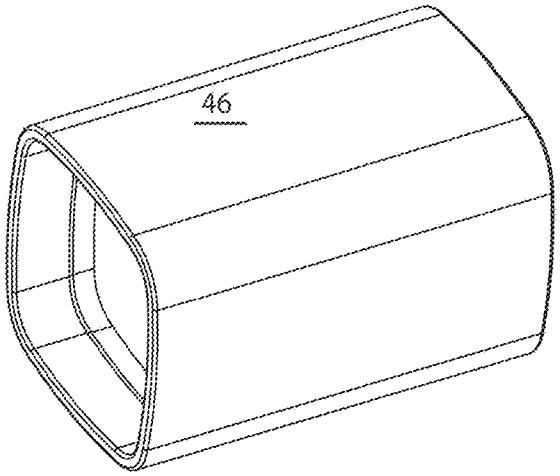
Figure 30 Part7
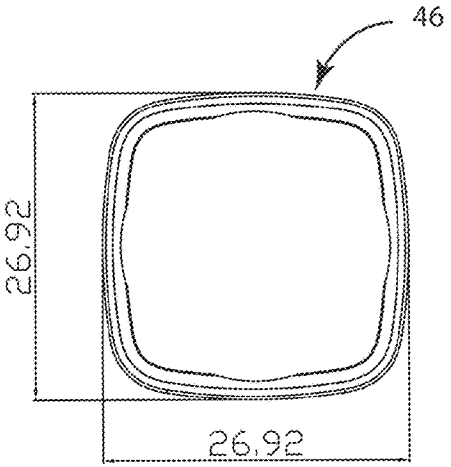
Figure 32

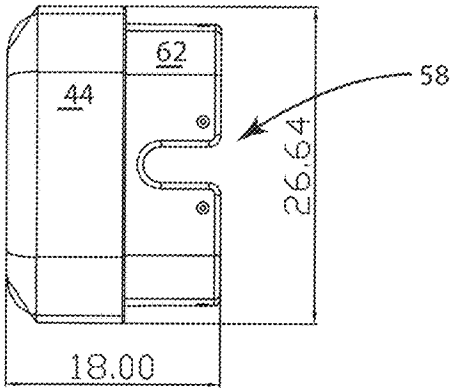
Figure 35
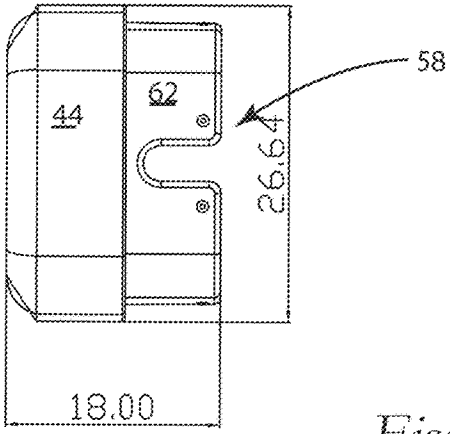
Figure 37
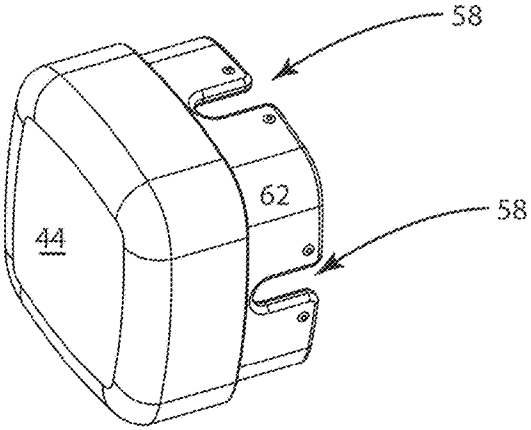
Figure 34 Part8
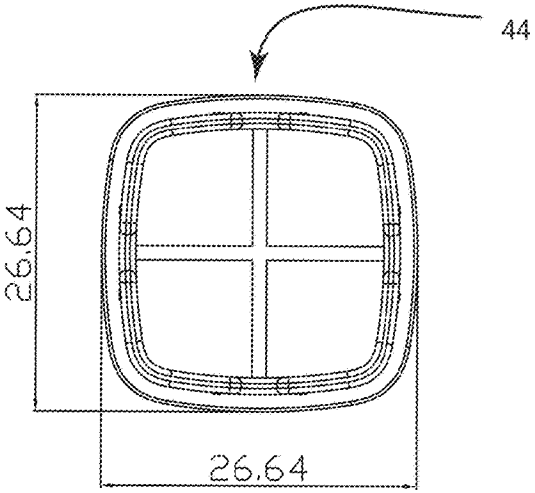
Figure 36

NEEDLE STORAGE DEVICE

This application claims priority of U.S. provisional Application No. 62/878,714 filed Jul. 25, 2019, incorporated by reference herein.

Humans have been sewing with needle and thread for thousands of years, yet is a rare seamstress that has a truly convenient way of storing needles which doesn't entail either the possibility of losing the collection all together, the chance of inadvertently bending needles, or tolerating storage of inordinate size that makes it difficult to rapidly locate and select the appropriate needle for her immediate application. This invention makes it possible to store needles in a single compact device which protects needles from bending forces yet make it possible to rapidly survey the available needles and select the appropriate size conveniently. Further, this device preferably incorporates a removable dispenser/storage module for thread treatment composition making it possible to apply thread treatment composition to thread immediately after threading a needle just prior to use.

I provide a needle storage device having: a tubular elongate housing, a first cylindrical tube adapted to be received and retained in the tubular elongate housing; the first cylindrical tube having: a pair of longitudinally extending slots formed in a portion of its peripheral wall, and also having a pair of circumferentially extending slots formed near a distal terminus of the cylindrical tube and extending through a minor portion of the circumference of the cylindrical tube, each of the longitudinal slot intersecting one of the circumferentially extending slots; a second cylindrical tube, having a pair of advancement lugs mounted upon its exterior surface, the second cylindrical tube being adapted to reciprocate within the first cylindrical tube, with each of the advancement lugs extending through one of the longitudinally extending slots in the first cylindrical tube; a rotatable third cylindrical tube adapted to be retained over the first cylindrical tube, the third cylindrical tube having a pair of generally helical channels defined in its interior surface with each of the advancement lugs engaging one of the generally helical channels; a mounting retainer adapted to engage the tubular elongate housing, the mounting retainer having a tubular protrusion extending proximally therefrom, the tubular protrusion having a cylindrical bearing surface defined therein, the cylindrical bearing surface adapted to rotatably retain the third cylinder with a portion of said the cylinder protruding through the mounting retainer, a deformable mounting medium being disposed with the second cylindrical tube, the second cylindrical tube being advanceable and retractable in the rotatable third cylindrical tube by turning the third tube about its longitudinal axis.

In preferred embodiments, the storage device further comprises a thread treatment storage vessel mateable with one end of the storage device, the storage vessel having plurality of thread treatment access openings formed in a portion of its sidewall which is mateable within the storage device.

In most cases, the storage device further comprises a removable, preferably transparent, cap mateable with the mounting retainer.

BRIEF DESCRIPTION OF THE DRAWINGS

FIGS. 14-17 are an isometric perspective of the rotatable third cylinder of a needle storage case of the present invention along with left elevation, front and plan elevation views thereof. The helical drive grooves thereof on the interior surface thereof are illustrated in phantom.

FIGS. 30-33 are an isometric perspective of the tubular elongated housing of a needle storage case of the present invention along with left elevation, front and plan elevation views thereof.

FIGS. 34-37 are an isometric perspective of the thread treatment storage compartment forming the lower terminus of the needle storage case of the present invention along with left elevation, front and plan elevation views thereof.

DESCRIPTION OF THE PREFERRED EMBODIMENT

Figure 1:
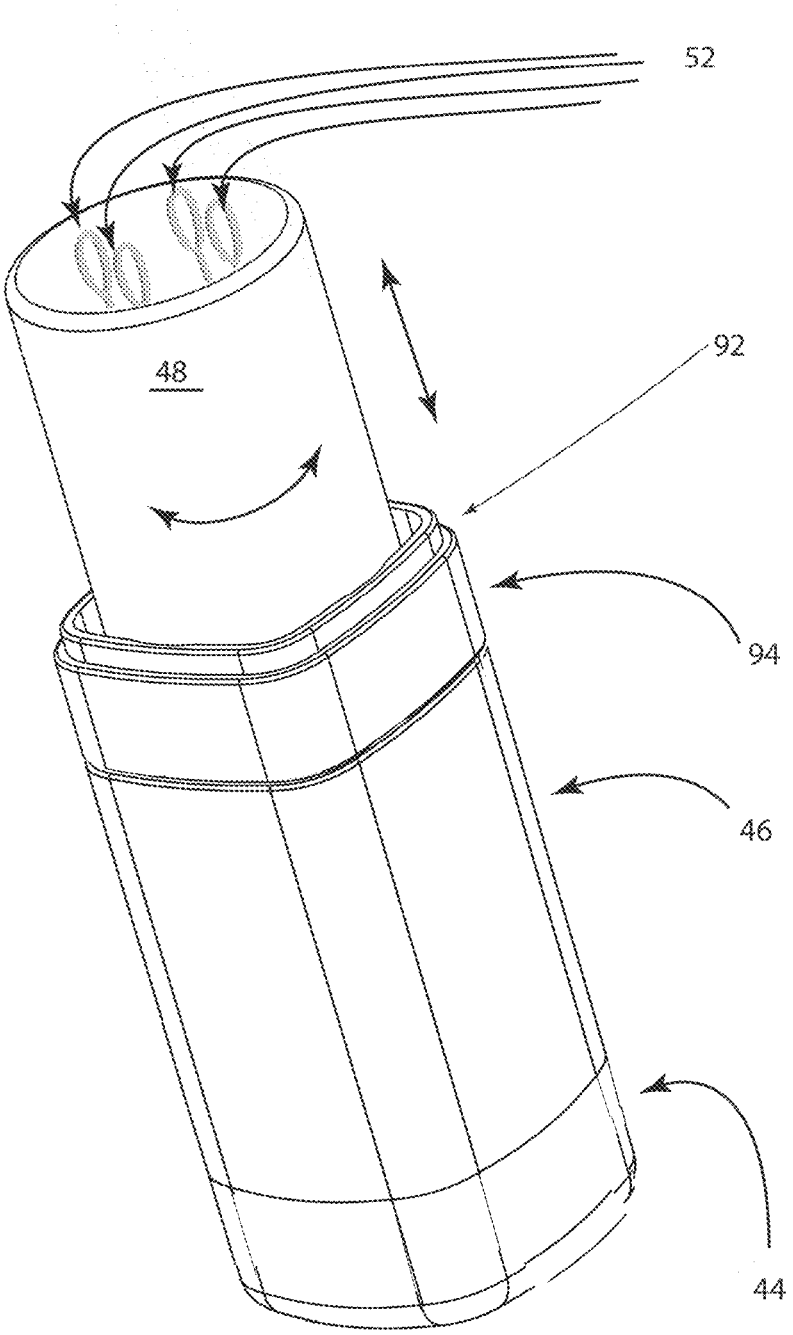
FIG. 1 is an isometric perspective view of a needle storage device of the present invention with the needles in the fully retracted position protecting them from deformation during storage and/or transport. The cap placeable over the portal from which needles are withdrawn is absent in this view.
Figure 2:
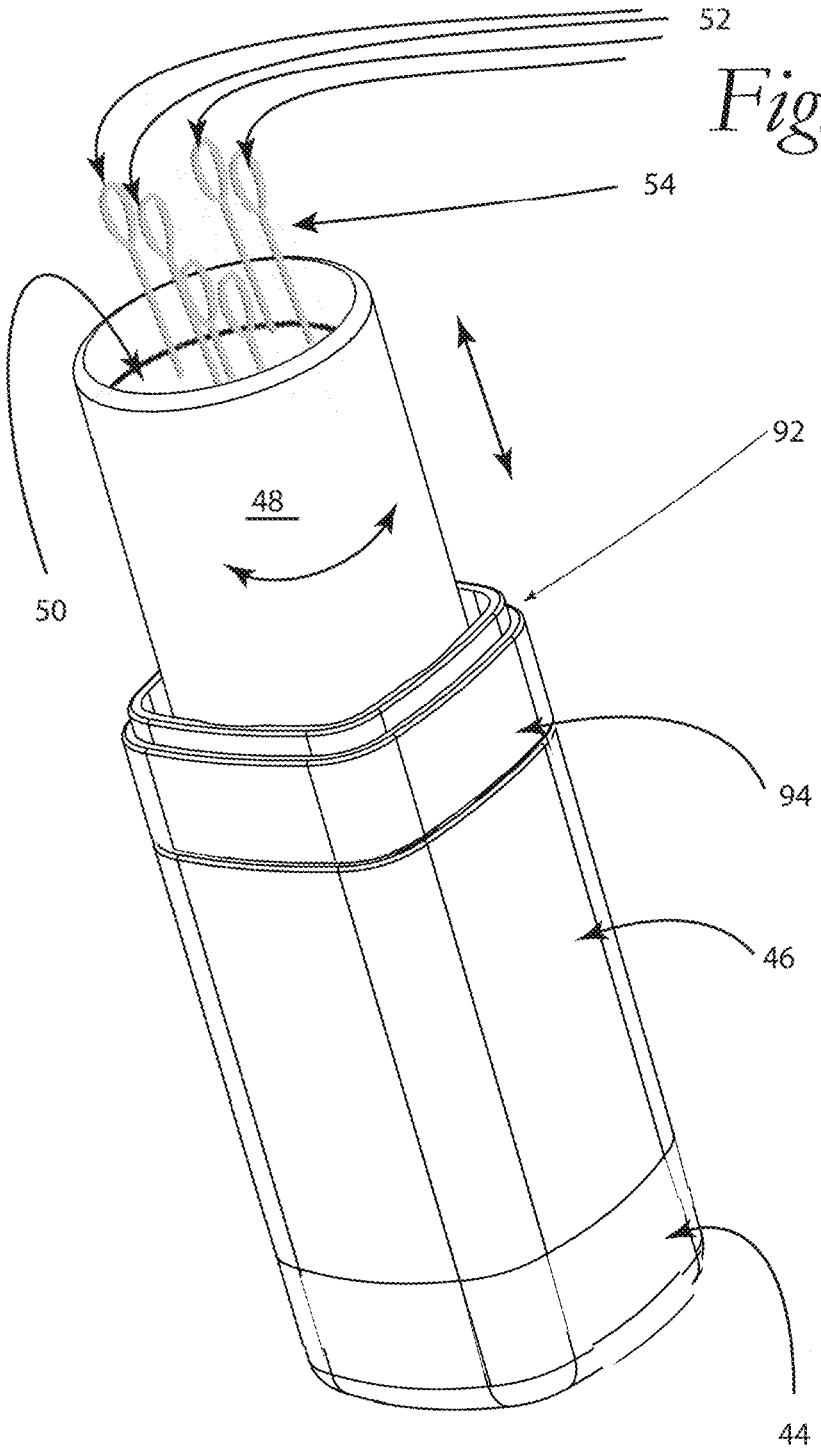
FIG. 2 is an isometric perspective view of a needle storage device of the present invention with the needles in a partially retracted position. The cap placeable over the portal from which needles are withdrawn is absent in this view.
Figure 3:
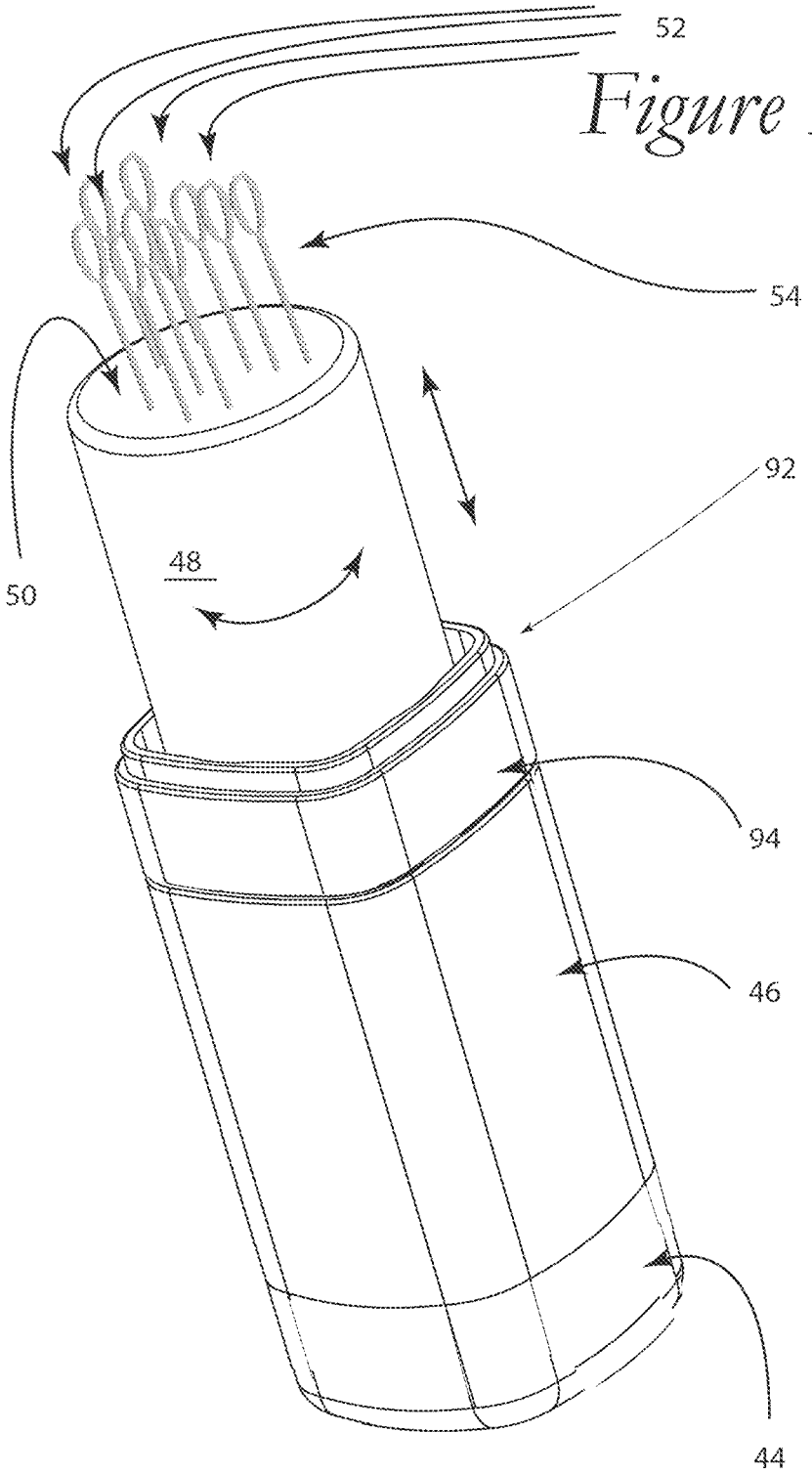
FIG. 3 is an isometric perspective view of a needle storage device of the present invention with the needles in the fully extended position. The cap placeable over the portal from which needles are withdrawn is absent in this view.

In FIGS. 1-3, an isometric view of an assembled needle storage device 42 of the present invention having thread treatment storage compartment 44 adjoining tubular elongate housing 46 having third rotatable cylinder 48 with deformable needle positioning medium 50 disposed within. Eyes 52 of needles 54 are visible inside rotatable third cylindrical tube 48 in FIG. 1, whilst in FIG. 2, needles 54 are projecting further from rotatable third cylindrical tube 48 with deformable needle positioning medium 50 visible whilst in FIG. 3 needles 54 are fully projecting from needle storage device 42. It will be easily appreciated that in FIG. 1, needles 54 are fully protected even in the absence of cap 56 but when fully advanced may be easily removed from needle storage device 42. Going from fully extended to fully protected is easily accomplished by twisting of rotatable third cylindrical tube 48.

Figures 4, 5:
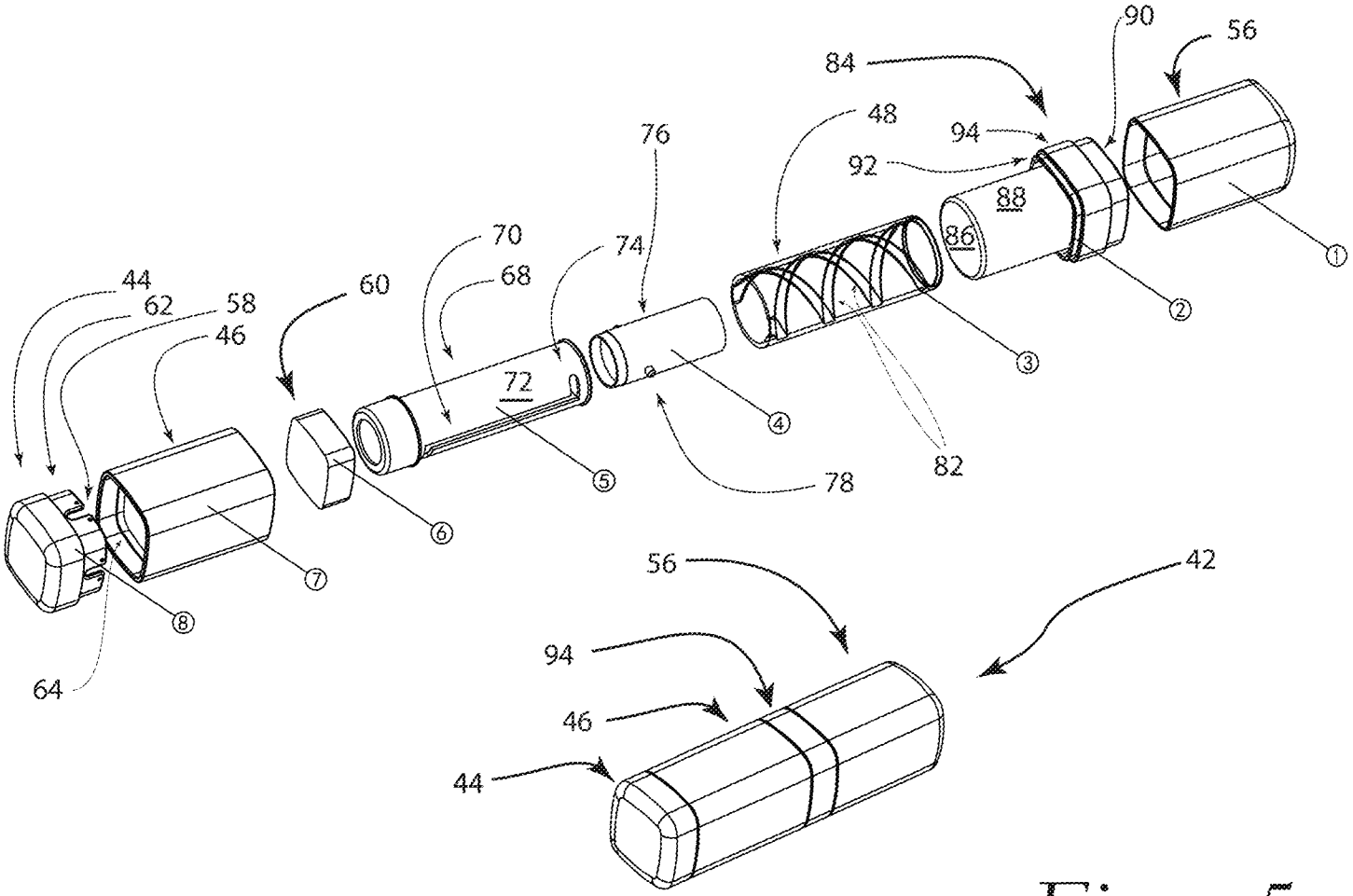
FIG. 4 is an exploded isometric perspective view of a needle storage device of the present invention illustrating the interrelationship between the various parts thereof.
FIG. 5 is an isometric perspective view of a needle storage device of the present invention with a cap in place over the portal from which the needles are withdrawn.
Figure 7:
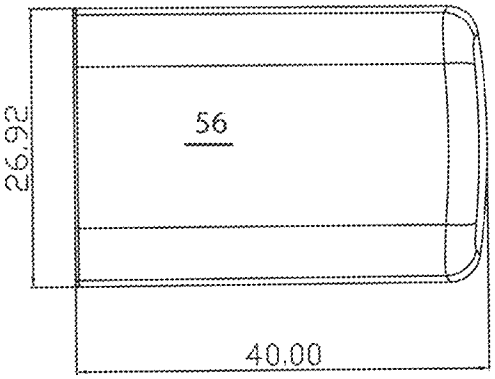
FIGS. 6-9 are an isometric perspective of the cap of a needle storage case of the present invention along with left elevation, front and plan elevation views thereof.
Figure 9:
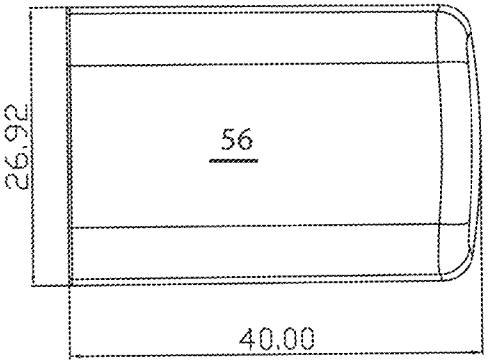
Figure 6:
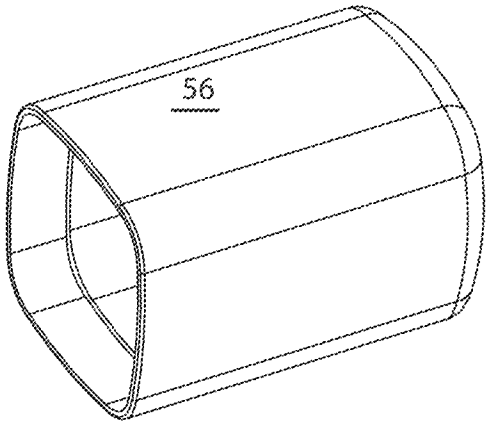
Figure 8:
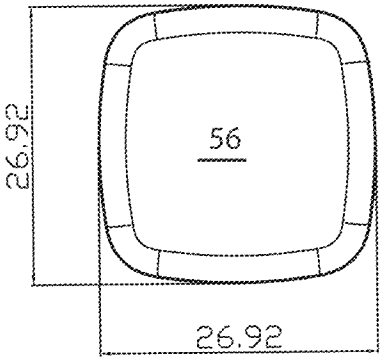
Figure 10:
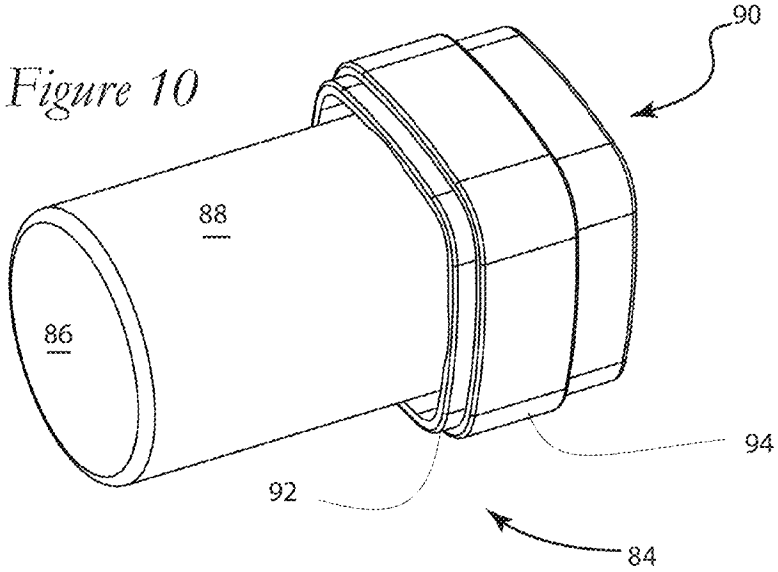
FIGS. 10-13 are an isometric perspective of the mounting retainer of a needle storage case of the present invention along with left elevation, front and plan elevation views thereof.
Figure 11:
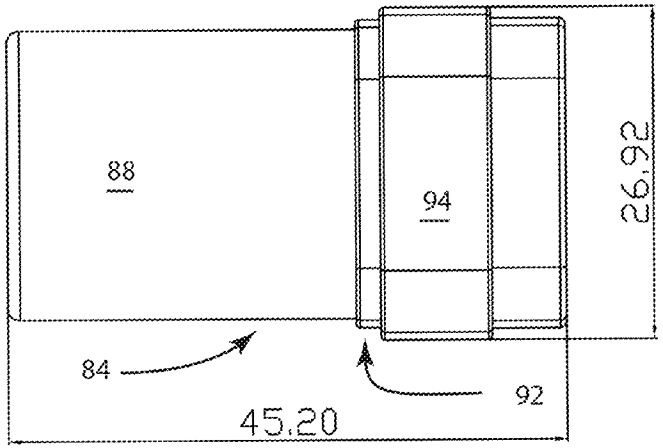
Figure 13:
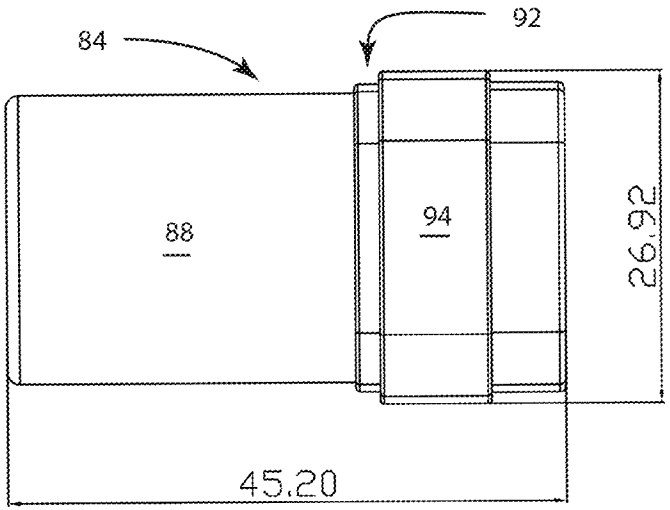
Figure 12:
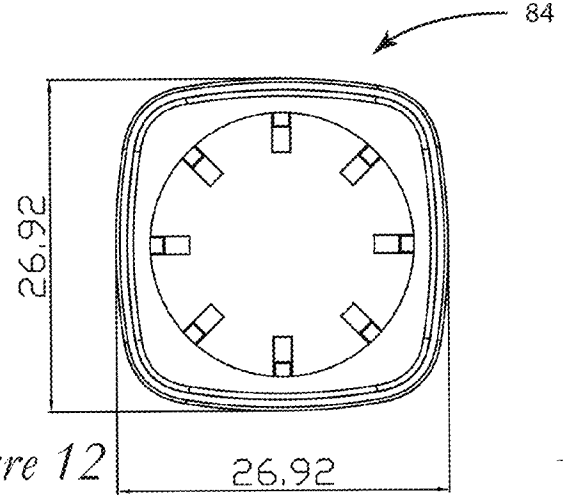
Figure 18:
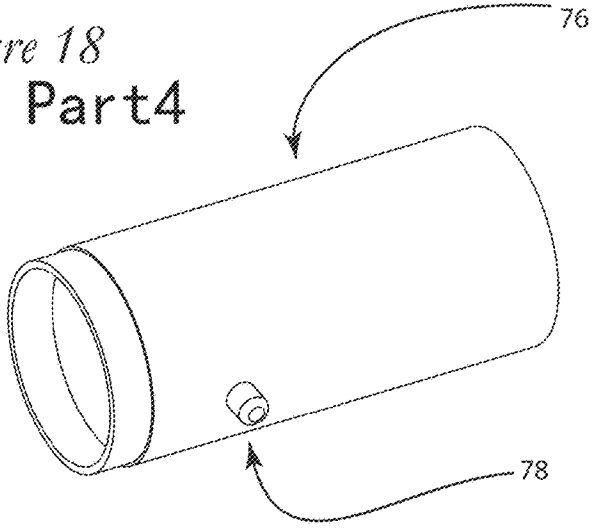
FIGS. 18-21 are an isometric perspective of the second cylindrical tube of a needle storage case of the present invention along with left elevation, front and plan elevation views thereof. The advancement lugs thereof on the exterior surface thereof are illustrated.
Figure 19:
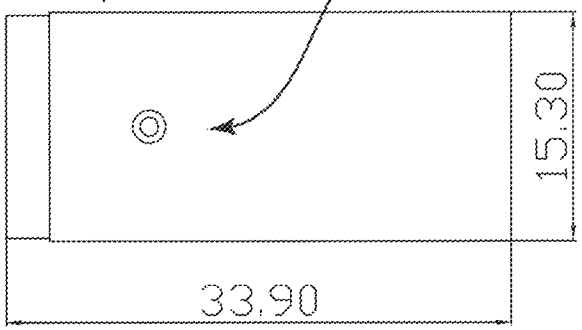
Figure 20:
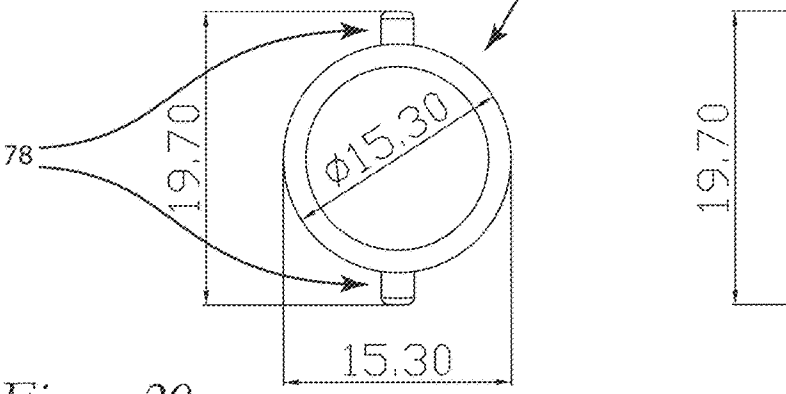
Figure 21:
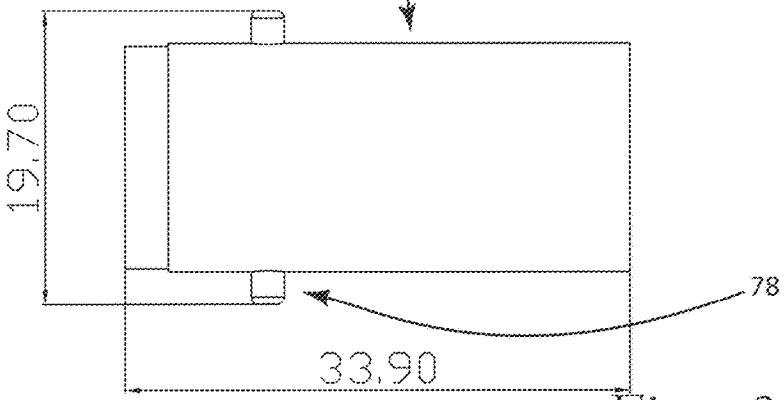
Figure 23:
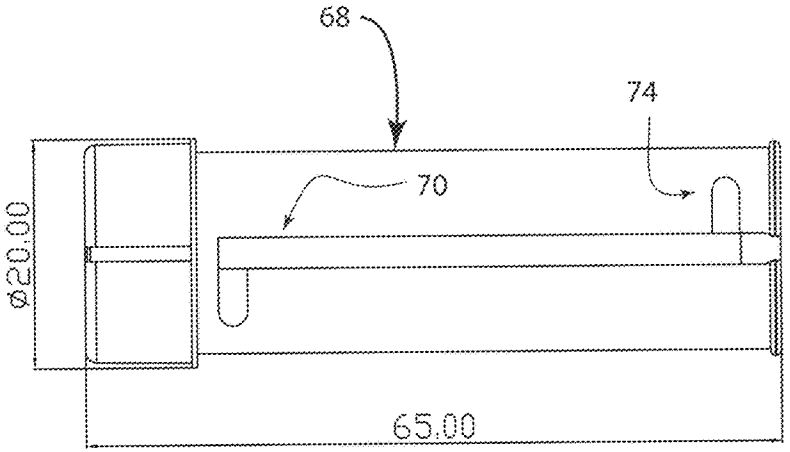
FIGS. 22-25 are an isometric perspective of the first cylindrical tube of a needle storage case of the present invention along with left elevation, front and plan elevation views thereof.
Figure 25:
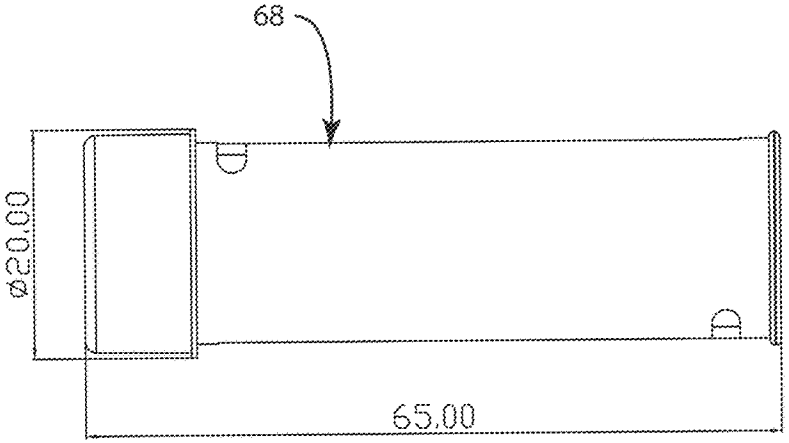
Figure 22:
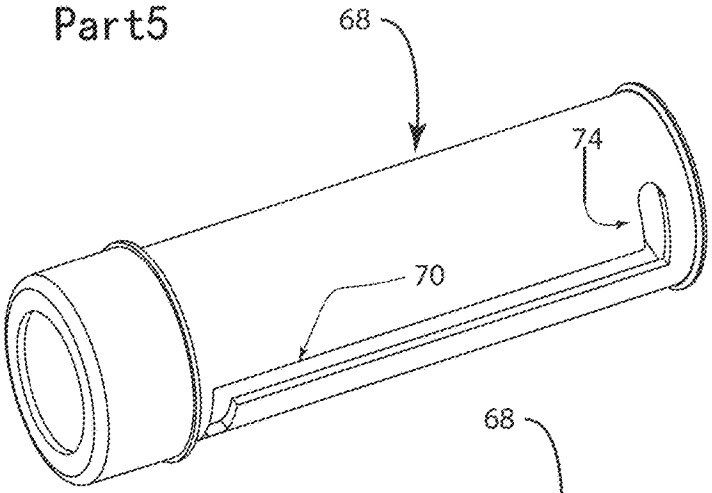
Figure 24:
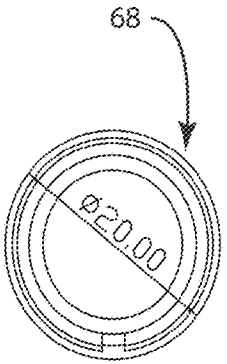
Figure 26:
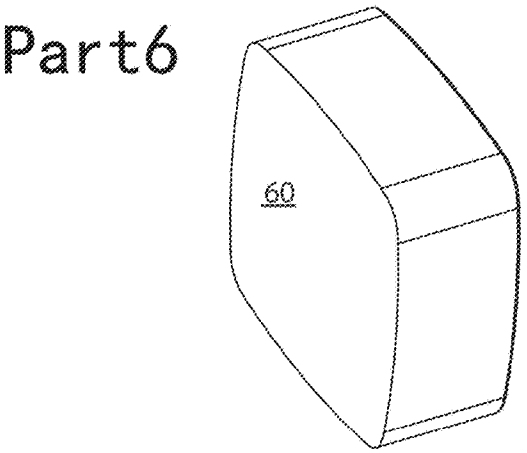
FIGS. 26-29 are an isometric perspective of the slug of threat treatment composition used in the thread treatment storage compartment of a needle storage case of the present invention along with left elevation, front and plan elevation views thereof.
Figure 27:
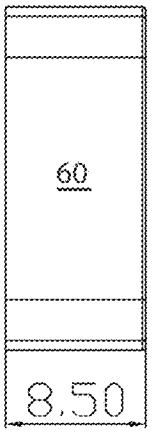
Figure 28:
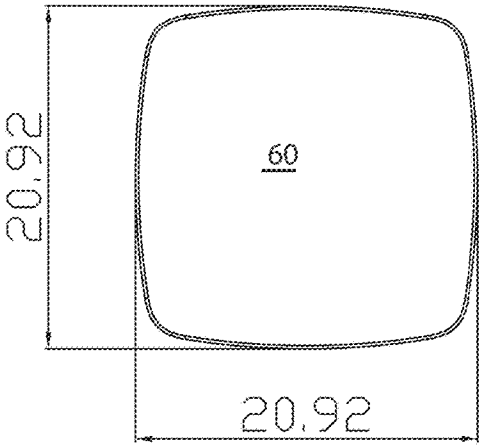
Figure 29:
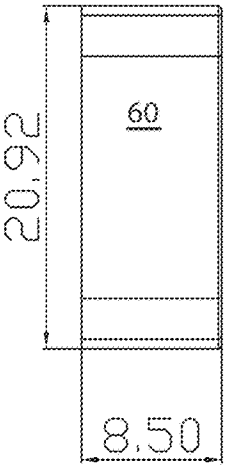

In FIG. 4, the interrelationship between the various components of needle storage device 42 can be appreciated. Part 8 is thread treatment storage vessel 44 having access openings 58 for application of thread treatment composition 60 by drawing of thread through thread treatment composition 60 through access slots 58. Access slots 58 are formed in recessed mateable sidewalls 62 of thread treatment storage compartment 44 which is insertable into proximal opening 64 in first tubular elongate housing 46 (part 7 in FIG. 4) being retainable therein by friction. Thread treatment composition 60 (part 6 in FIG. 4) is retained in thread treatment storage compartment 44 for ready application to thread for use with needles 54. Part 5 in FIG. 4 is first cylindrical tube 68 having longitudinally extending slots 70 formed through wall 72 thereof, each adjoining and communicating with circumferential slots 74 extending about a minor portion of the circumference of first cylindrical tube 68. Part 4 in FIG. 4 is second cylindrical tube 76 containing deformable mounting medium 50 therein, second cylindrical tube 76 having advancement lugs 78 formed exteriorly thereupon, advancement lugs 78 being configured to extend through longitudinally extending slots 70 formed through wall 72 of first cylindrical tube 68 which advancement lugs 78 engage helical channels 82 formed interiorly into rotatable third cylindrical tube 48 which passes through mounting retainer 84 which matingly engages tubular elongate housing 46 with rotatable third cylinder 48 engaging cylindrical bearing surface 86 formed interiorly to tubular protrusion 88 of mounting retainer 84 (part 2 of FIG. 4). Accordingly, it can be appreciated that second cylindrical tube 76 having advancement lugs 78 formed thereupon is the interiormost of the concentric tubes 48, 68, and 76 defining the present mechanism with first cylindrical tube 68 being disposed thereover and third cylindrical tube 48 having helical channels 82 formed interiorly thereto is the outermost of the three concentric tubes 48, 68 and 76. Upon rotation of third rotatable cylinder 48 about its longitudinal axis, second cylindrical tube 76 be advanced out of or withdrawn into third rotatable cylinder 48, exposing or protecting needles 54 as desired and illustrated in FIGS. 1-3. Lid 56 (part 1 of FIG. 4) is adapted to be mountable upon distal end 90 of mounting retainer 84 enveloping recessed mounting wall 92 formed on distal end 90 of mounting retainer 84 and being retained thereupon by friction. It is of course understood that where friction is specified as retaining various components hereof in position, male lugs engaging female depressions on the mating parts may also be used if more positive retention is deemed desirable.

FIG. 5 illustrates assembled needle storage device 42 of the present invention with thread treatment storage compartment 44 being defined distally mating with tubular elongate housing 46 which in turn matingly engages mounting retainer 84 with shoulder 94 thereof being visible in FIG. 5 and cap 56 being mounted distally on mounting retainer 84 forming a compact needle storage unit 42 in which needles may easily be stored and transported whilst being protected from deformation during storage and transport but remaining easily accessible when needed. Deformable mounting medium 50 may be a deformable polymer, a polymeric foam, a high melting wax, a fibrous bat or any yieldable medium into which needles 54 may penetrate easily, be positively retained therein for indefinite periods and easily removed when desired without undesirable residue being adhered thereto. FIGS. 6 through 37 are detail drawings of each of the constituent parts of the needle storage device 42 of the present invention.

As my invention, I claim:

1. A storage device for needles comprising:

a tubular elongate housing, a first cylindrical tube adapted to be received and retained in said tubular elongate housing;

said first cylindrical tube having: a pair of longitudinally extending slots formed in a portion of its peripheral wall, a pair of circumferentially extending slots formed near a distal terminus of said cylindrical tube and extending through a minor portion of the circumference of said cylindrical tube, each said longitudinal slot intersecting one of said circumferentially extending slots;

a second cylindrical tube, having a pair of advancement lugs mounted upon its exterior surface, said second cylindrical tube being adapted to reciprocate within said first cylindrical tube, with each said advancement lug extending through one of said longitudinally extending slots in said first cylindrical tube;

a rotatable third cylindrical tube adapted to be retained over said first cylindrical tube, said third cylindrical tube having a pair of generally helical channels defined in its interior surface with each said advancement lug engaging one of said generally helical channels;

a mounting retainer adapted to engage said tubular elongate housing, said mounting retainer having a tubular protrusion extending proximally therefrom, said tubular protrusion having a cylindrical bearing surface defined therein, said cylindrical bearing surface adapted to rotatably retain said third cylinder with a portion of said third cylinder protruding through said mounting retainer, a deformable needle mounting element being disposed within said second cylindrical tube, said second cylindrical tube being advanceable and retractable in said rotatable third cylindrical tube by turning of said third tube about its longitudinal axis, said deformable needle mounting element is adapted for retention therein and withdrawal of needles therefrom, wherein said deformable element is a material chosen from the group consisting of: deformable polymers, polymeric foams, high melting waxes, fibrous bats and combination thereof;

a thread treatment storage vessel mateable with one end of said storage device, said storage vessel having a plurality of thread treatment access openings formed in a portion of its sidewall which is mateable within said storage device;

a removable cap mateable with said mounting retainer.

2. A storage device for needles comprising:

a tubular elongate housing, a first cylindrical tube adapted to be received and retained in said tubular elongate housing;

said first cylindrical tube having: a pair of longitudinally extending slots formed in a portion of its peripheral wall, a pair of circumferentially extending slots formed near a distal terminus of said cylindrical tube and extending through a minor portion of the circumference of said cylindrical tube, each said longitudinal slot intersecting one of said circumferentially extending slots;

a second cylindrical tube, having a pair of advancement lugs mounted upon its exterior surface, said second cylindrical tube being adapted to reciprocate within said first cylindrical tube, with each said advancement lug extending through one of said longitudinally extending slots in said first cylindrical tube;

a rotatable third cylindrical tube adapted to be retained over said first cylindrical tube, said third cylindrical tube having a pair of generally helical channels defined in its interior surface with each said advancement lug engaging one of said generally helical channels;

a mounting retainer adapted to engage said tubular elongate housing, said mounting retainer having a tubular protrusion extending proximally therefrom, said tubular protrusion having a cylindrical bearing surface defined therein, said cylindrical bearing surface adapted to rotatably retain said third cylinder with a portion of said third cylinder protruding through said mounting retainer, a deformable needle mounting element being disposed within said second cylindrical tube, said second cylindrical tube being advanceable and retractable in said rotatable third cylindrical tube by turning of said third tube about its longitudinal axis.

3. The storage device of claim 2, further comprising a thread treatment storage vessel mateable with one end of said storage device, said storage vessel having a plurality of thread treatment access openings formed in a portion of its sidewall which is mateable within said storage device.

4. The storage device of claim 3 further comprising a removable cap mateable with said mounting retainer.

5. The storage device of claim 2 further comprising a removable cap mateable with said mounting retainer.

6. The storage device for needles of claim 2, wherein said deformable needle mounting element is adapted for retention therein and withdrawal of needles therefrom, wherein said deformable element is a material chosen from the group consisting of: deformable polymers, polymeric foams, high melting waxes, fibrous bats and combination thereof.

7. A storage device for needles comprising:

a tubular elongate housing, a first cylindrical tube adapted to be received and retained in said tubular elongate housing; a second cylindrical tube adapted to reciprocate within said first cylindrical tube; a rotatable third cylindrical tube adapted to be retained over said first cylindrical tube;

a mounting retainer adapted to engage said tubular elongate housing, said mounting retainer having a tubular protrusion extending proximally therefrom, said tubular protrusion having a cylindrical bearing surface defined therein, said cylindrical bearing surface adapted to rotatably retain said third cylinder with a portion of said third cylinder protruding through said mounting retainer, a deformable needle mounting element being disposed with said second cylindrical tube, said deformable needle mounting element being adapted to retain needles therein and for withdrawal of needles therefrom, said second cylindrical tube being advanceable and retractable in said rotatable third cylindrical tube by turning of said third tube about its longitudinal axis.

8. The storage device for needles of claim 7, wherein said deformable mounting element is adapted for retention therein and withdrawal of needles therefrom, wherein said deformable element is a material chosen from the group consisting of: deformable polymers, polymeric foams, high melting waxes, fibrous bats and combination thereof.

9. The storage device of claim 8, further comprising a thread treatment storage vessel mateable with one end of said storage device, said storage vessel having a plurality of thread treatment access openings formed in a portion of its sidewall which is mateable within said storage device.

10. The storage device of claim 9 further comprising a removable cap mateable with said mounting retainer.

11. The storage device of claim 7, further comprising a thread treatment storage vessel mateable with one end of said storage device, said storage vessel having a plurality of thread treatment access openings formed in a portion of its sidewall which is mateable within said storage device.

12. The storage device of claim 7 further comprising a removable cap mateable with said mounting retainer.

* * * * *